US006220824B1

(12) United States Patent
Hablanian

(10) Patent No.: US 6,220,824 B1
(45) Date of Patent: Apr. 24, 2001

(54) SELF-PROPELLED VACUUM PUMP

(75) Inventor: Marsbed Hablanian, Wellesley, MA (US)

(73) Assignee: Varian, Inc., Palo Alto, CA (US)

( * ) Notice: Subject to any disclaimer, the term of this patent is extended or adjusted under 35 U.S.C. 154(b) by 0 days.

(21) Appl. No.: 09/337,857

(22) Filed: Jun. 21, 1999

(51) Int. Cl.[7] ..... F04B 3/00; F04B 23/14
(52) U.S. Cl. ..... 417/245; 417/201
(58) Field of Search ..... 417/245, 201, 417/382, 390, 406; 415/90, 143

(56) References Cited

U.S. PATENT DOCUMENTS

| | | | | |
|---|---|---|---|---|
| Re. 33,129 | * | 12/1989 | Mase et al. | 415/90 |
| 2,235,763 | * | 3/1941 | Horton et al. | 415/231 |
| 2,613,030 | * | 10/1952 | Troy | 416/171 |
| 3,969,039 | * | 7/1976 | Shoulders | 417/244 |
| 5,074,747 | * | 12/1991 | Ikegami et al. | 415/55 |
| 5,219,269 | * | 6/1993 | Ikegami et al. | 415/90 |
| 5,238,362 | * | 8/1993 | Casaro et al. | 415/90 |
| 5,611,660 | * | 3/1997 | Wong et al. | 415/90 |
| 5,695,316 | * | 12/1997 | Schutz et al. | 415/90 |

FOREIGN PATENT DOCUMENTS

| | | | | |
|---|---|---|---|---|
| 3919529 | | 1/1990 | (DE) . | |
| 0 568 069 A2 | * | 11/1993 | (EP) | F04D/19/04 |
| 1-262399 | * | 1/1989 | (JP) . | |

* cited by examiner

*Primary Examiner*—Timothy S. Thorpe
*Assistant Examiner*—Michael K. Gray
(74) *Attorney, Agent, or Firm*—Bella Fishman

(57) ABSTRACT

A vacuum pump, such as a turbomolecular pump, a molecular drag pump or a hybrid pump, is adapted for use with a backing pump. The vacuum pump includes a housing having an inlet port and an exhaust port for coupling to the backing pump, one or more vacuum pumping stages disposed in the housing, each of the vacuum pumping stages having a stationary member and a rotating member, and a gas turbine. The gas turbine includes a gas inlet, a gas outlet coupled to the exhaust port, and a rotor coupled to the rotating members of the vacuum pumping stages. A gas flow, produced by the backing pump, through the gas turbine causes the rotor and the rotating members of the vacuum pumping stages to rotate, wherein gas is pumped by the vacuum pumping stages from the inlet port to the exhaust port.

24 Claims, 5 Drawing Sheets

SELF-PROPELLED VACUUM PUMP

FIELD OF THE INVENTION

This invention relates to high vacuum pumps used for evacuating an enclosed vacuum chamber and, more particularly, to compact, low cost vacuum pumps. The invention relates to improvements in prior art vacuum pumps of the type which incorporate an electric motor, such as for example turbomolecular pumps, molecular drag pumps and hybrid pumps.

BACKGROUND OF THE INVENTION

Conventional turbomolecular vacuum pumps include a housing having an inlet port, an interior chamber containing a plurality of axial pumping stages and an exhaust port. The exhaust port is typically attached to a roughing vacuum pump. Each axial pumping stage includes a stator having inclined blades and a rotor having inclined blades. The rotor and stator blades are inclined in opposite directions. The rotor blades are rotated at high speed by a motor to pump gas between the inlet port and the exhaust port. A typical turbomolecular vacuum pump may include nine to twelve axial pumping stages.

Variations of the conventional turbomolecular vacuum pump are known in the art. In one prior art configuration, one or more of the axial pumping stages are replaced with disks which rotate at high speed and function as molecular drag stages. This configuration is disclosed in U.S. Pat. No. 5,238,362 issued Aug. 24, 1993 to Casaro et al. A turbomolecular vacuum pump including an axial turbomolecular compressor and a molecular drag compressor in a common housing is sold by Varian, Inc. under Model No. 969-9007. Turbomolecular vacuum pumps utilizing molecular drag disks and regenerative impellers are disclosed in German Patent No. 3,919,529 published Jan. 18, 1990.

Molecular drag compressors include a rotating disk and a stator. The stator defines a tangential flow channel and an inlet and an outlet for the tangential flow channel. A stationary baffle, often called a stripper, disposed in the tangential flow channel separates the inlet and the outlet. As is known in the art, the momentum of the rotating disk is transferred to gas molecules within the tangential flow channel thereby directing the molecules toward the outlet Another type of molecular drag compressor includes a cylindrical drum that rotates within a housing having a cylindrical interior wall in close proximity to the rotating drum. The outer surface of the cylindrical drum is provided with a helical groove. As the drum rotates, gas is pumped through the groove by molecular drag.

A prior art high vacuum pump is shown in FIG. 4. A housing 10 defines an interior chamber 12 having an inlet port 14 and an exhaust port 16. The housing 10 includes a vacuum flange 18 for sealing the inlet port to a vacuum chamber (not shown) to be evacuated. The exhaust port 16 is typically connected to a roughing vacuum pump (not shown). In cases where the vacuum pump is capable of exhausting to atmospheric pressure, the roughing pump is not required. Located within housing 10 is an axial turbomolecular compressor 20, which typically includes several axial turbomolecular stages, and a molecular drag compressor 22, which typically includes several molecular drag stages. Each stage of the axial turbomolecular compressor 20 includes a rotor 24 and a stator 26. Each rotor and stator has inclined blades as is known in the art. Each stage of the molecular drag compressor 22 includes a rotor disk 30 and a stator 32. The rotor 24 of each turbomolecular stage and the rotor 30 of each molecular drag stage are attached to a drive shaft 34. The drive shaft 34 is rotated at high speed by a motor located in a motor housing 38.

Turbomolecular vacuum pumps and related types of vacuum pumps are used in a wide variety of applications. In many applications, the physical size of the vacuum pump is an important system design consideration. For example, vacuum pumps are frequently used in semiconductor processing equipment that is located in or adjacent to clean room facilities, and strict limitations are placed on the size of the equipment. Another application requiring small size is portable instruments, such as miniature mass spectrometers. In such applications, the electric motor adds significantly to the size, weight and cost of the vacuum pump.

A prior art large capacity turbomolecular pump has been driven by a gas turbine, which in turn was driven by an air compressor. Because of the need for an air compressor, the prior art pump was expensive and required a tight rotary seal between the pump and turbine sections.

Accordingly, there is a need for vacuum pumps which are compact, which are low in cost and which are simple to manufacture.

SUMMARY OF THE INVENTION

According to a first aspect of the invention, a vacuum pump is provided. The vacuum pump comprises a housing having an inlet port and an exhaust port for coupling to a backing pump, one or more vacuum pumping stages disposed in the housing, each of the vacuum pumping stages comprising a stationary member and a rotating member, and a gas turbine. The gas turbine comprises a gas inlet, a gas outlet coupled to the exhaust port and a rotor coupled to the rotating members of the vacuum pumping stages. A gas flow, produced by the backing pump, through the gas turbine causes the rotor and the rotating members of the vacuum pumping stages to rotate, wherein gas is pumped by the vacuum pumping stages from the inlet port to the exhaust port.

The exhaust port of the vacuum pump may be adapted for direct coupling to a backing pump or may be adapted for coupling to a centralized vacuum system having a remotely-located backing pump.

The gas turbine may include a valve for controlling gas flow through the gas turbine. The gas turbine may include a nozzle for directing the gas flow to the rotor of the gas turbine. The nozzle inlet may operate at or below atmospheric pressure.

The gas turbine may be positioned adjacent to a last stage of the vacuum pumping stages and may be located in the same housing with the vacuum pumping stages. The rotor of the gas turbine and the rotating members of the vacuum pumping stages may be coupled to a common shaft.

In a first embodiment, at least one of the vacuum pumping stages comprises an axial turbomolecular stage wherein the rotating member and the stationary member have inclined blades. In a second embodiment, at least one of the vacuum pumping stages comprises a molecular drag stage having a stationary member that is provided with a tangential flow channel having an inlet and an outlet separated by a stationary baffle, and a rotating member comprising a disk. In a third embodiment, at least one of the vacuum pumping stages comprises a regenerative stage. In a fourth embodiment, the vacuum pumping stages comprise one or more axial turbomolecular stages and one or more molecular drag stages.

According to another aspect of the invention, a vacuum pumping system is provided. The vacuum pumping system comprises a vacuum pump including a housing having an inlet port and an exhaust port, one or more vacuum pumping stages disposed in the housing, each of the vacuum pumping stages having a stationary member and a rotating member, and a gas turbine. The gas turbine comprises a gas inlet, a gas outlet coupled to the exhaust port and a rotor coupled to the rotating members of the vacuum pumping stages. The vacuum pumping system further comprises a backing pump coupled to the exhaust port of the vacuum pump, wherein a gas flow, produced by the backing pump, through the gas turbine causes the rotor and the rotating members of the vacuum pumping stages to rotate, wherein gas is pumped by the vacuum pumping stages from the inlet port to the exhaust port

BRIEF DESCRIPTION OF THE DRAWINGS

For a better understanding of the present invention, reference is made to the accompanying drawings, which are incorporated herein by reference and in which.

DETAILED DESCRIPTION

Figure 1:
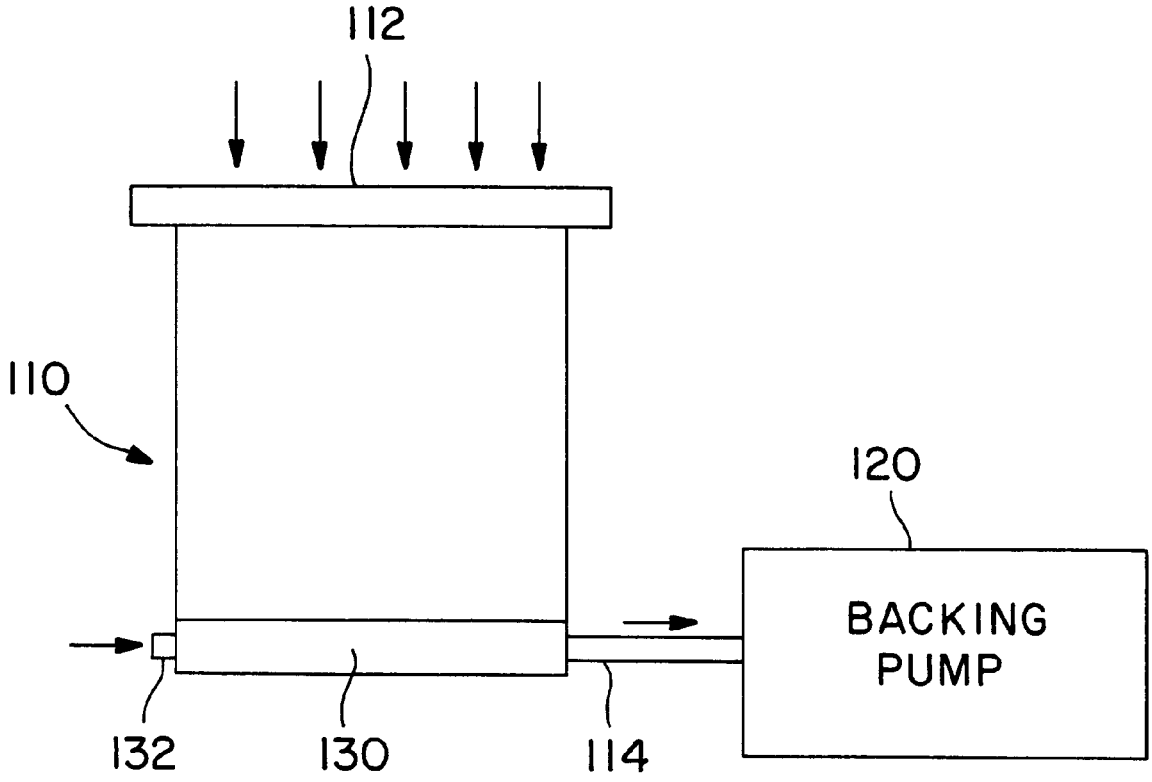
FIG. 1 is a block diagram of a vacuum pumping system incorporating a self-propelled vacuum pump in accordance with an embodiment of the invention.

A block diagram of a vacuum pumping system in accordance with an embodiment of the invention is shown in FIG. 1. A vacuum pump 110 includes an inlet port 112 and an exhaust port 114. In use, inlet port 112 is sealed to a vacuum chamber (not shown) to be evacuated. Exhaust port 114 is connected by a suitable conduit to a backing pump 120. Backing pump 120 may be a roughing vacuum pump that is configured for operation at a relatively low vacuum level, i.e. near one tenth of atmospheric pressure.

Vacuum pump 110 includes one or more vacuum pumping stages, each having a stationary member and a rotating member, as described below. Examples of such vacuum pumps include turbomolecular pumps, molecular drag pumps and hybrid pumps. Vacuum pump 110 further includes a gas turbine 130 located adjacent to exhaust port 114. The gas turbine is preferably driven by atmospheric air. Gas turbine 130 includes a gas inlet 132, a gas outlet coupled to exhaust port 114 and a rotor (not shown in FIG. 1) coupled to the rotating members of the vacuum pumping stages.

In operation, backing pump 120 pumps air through gas turbine 130 from gas inlet 132 to gas outlet 115 coupled to exhaust port 114, thereby causing the rotor of the gas turbine 130 to rotate. The rotation produced by backing pump 120 in turn causes rotation of the rotating members of vacuum pump 110, so that gas is pumped by the vacuum pumping stages from inlet port 112 to exhaust port 114. Thus, vacuum pump 110 operates without an electric motor.

Backing pump 120 may have any convenient location with respect to vacuum pump 110. Thus, backing pump 120 may be located in close proximity to vacuum pump 10 or may be at a remote location. For example, exhaust port 114 of vacuum 110 may be connected to a centralized vacuum system in a hospital, laboratory or other facility. The centralized vacuum system may be driven by a backing pump that is connected by suitable conduits to various locations in the facility.

Figure 2:
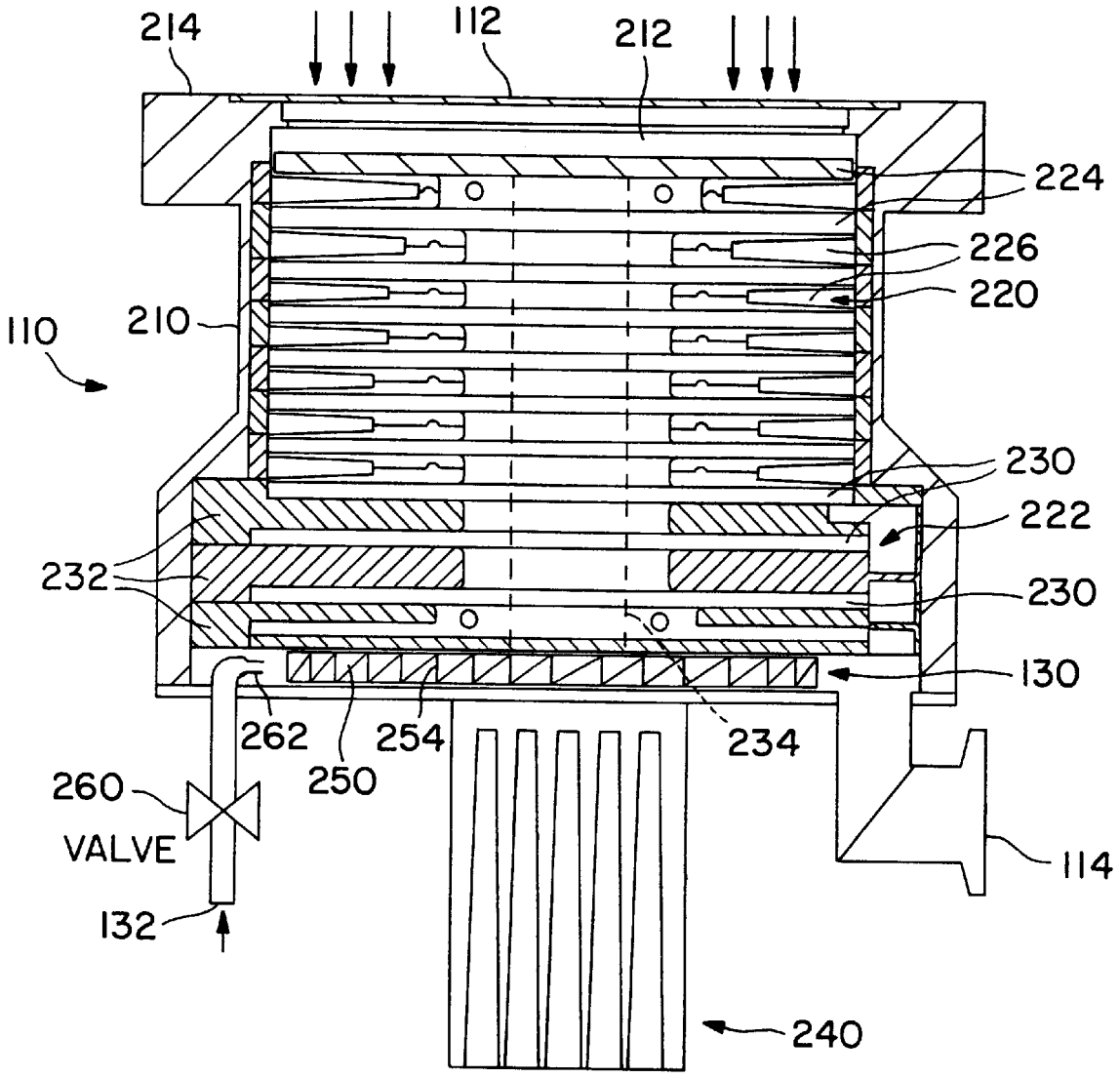
FIG. 2 is an elevation view, partly in cross section, of a self-propelled vacuum pump in accordance with an embodiment of the invention.

An example of an implementation of vacuum pump 110 is shown in FIG. 2. A housing 210 defines an interior chamber 212 having inlet port 112 and exhaust port 114. The housing 210 includes a vacuum flange 214 for sealing inlet port 112 to a vacuum chamber (not shown) to be evacuated. Exhaust port 114 is adapted for coupling to a backing pump as shown in FIG. 1 and described above. Located within housing 210 is an axial turbomolecular compressor 220, which typically includes several axial turbomolecular stages, and a molecular drag compressor 222, which typically includes several molecular drag stages. Each stage of the axial turbomolecular compressor 220 includes a rotor 224 and a stator 226. Each rotor and stator has inclined blades as is known in the art. Each stage of the molecular drag compressor 222 includes a rotor disk 230 and a stator 232. The rotor 224 of each turbomolecular stage and the rotor disk 230 of each molecular drag stage are attached to a drive shaft 234. The drive shaft 234 is rotated at high speed by gas turbine 130. A bearing housing 240 may contain bearings for supporting drive shaft 234.

Figure 3:
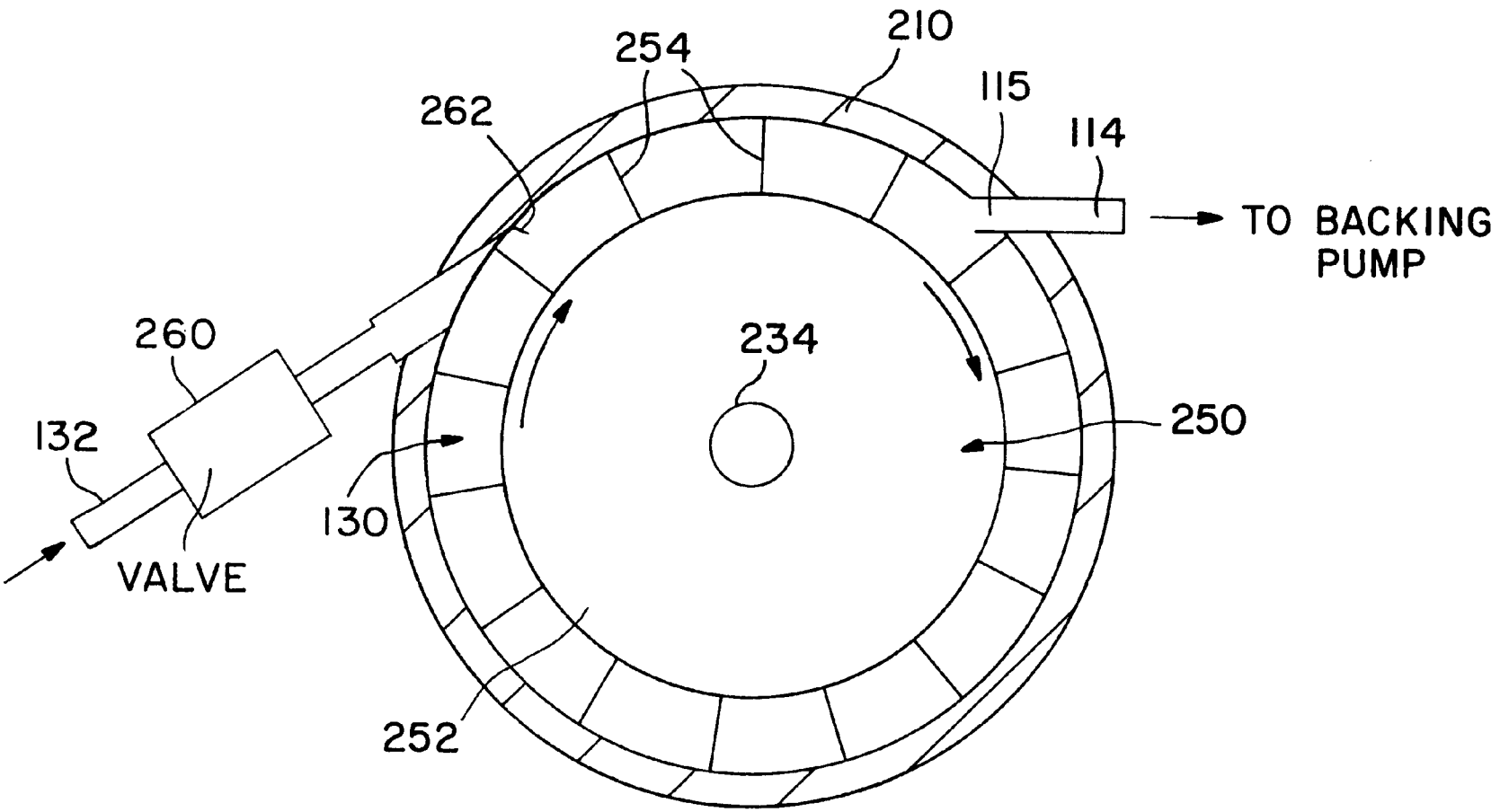
FIG. 3 is a simplified plan view of an example of the gas turbine used in the vacuum pump of FIG. 2.
Figure 4:
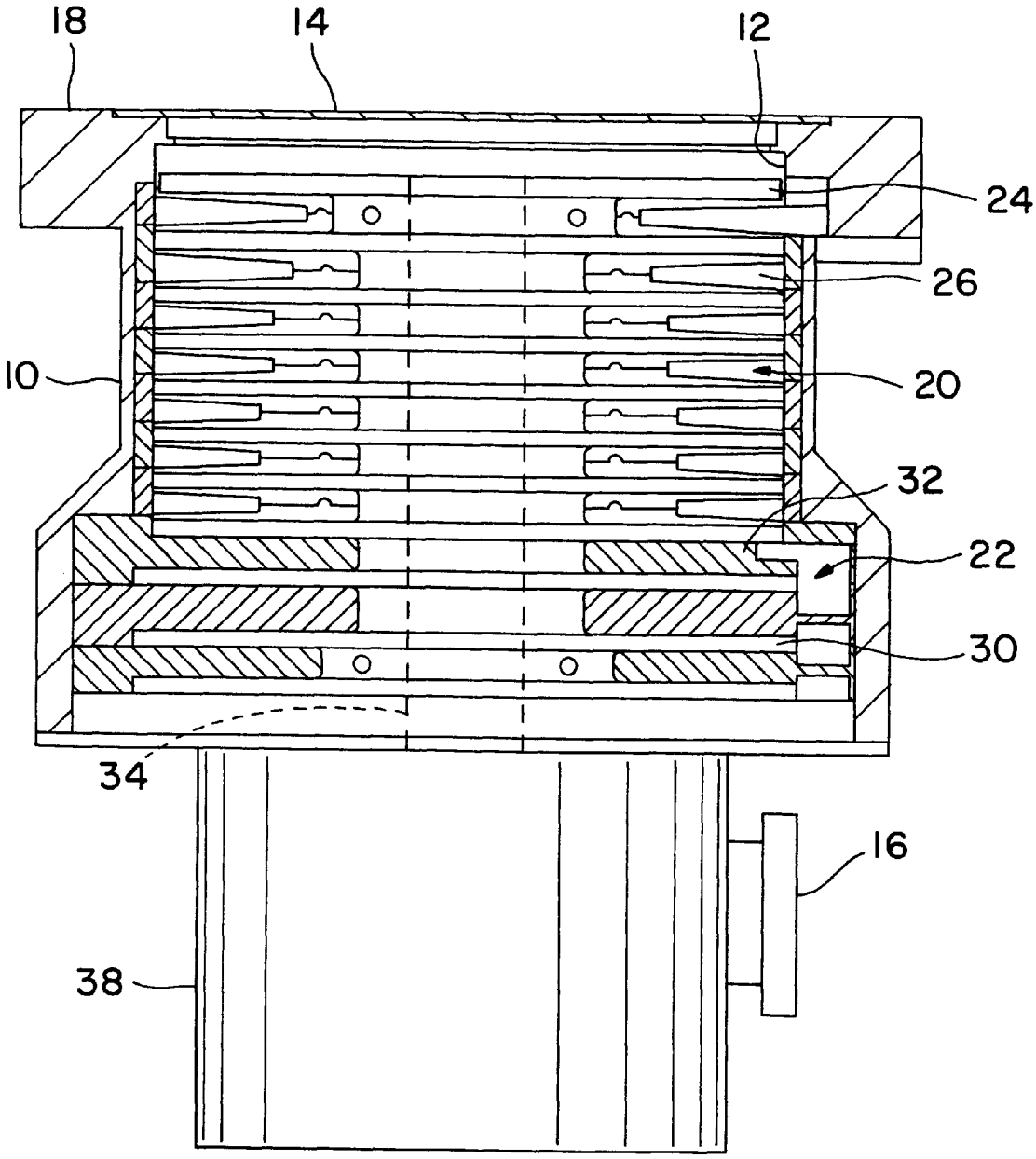
FIG. 4 PRIOR ART
FIG. 4 is a elevation view, partly in cross-section, of a prior art vacuum pump.

Gas turbine 130 is illustrated by way of example in FIGS. 2 and 3. Gas turbine 130 includes gas inlet 132, a rotor 250 and a gas outlet coupled to exhaust port 114. Rotor 250 is coupled to drive shaft 234 and includes a rotor body 252 and peripheral blades 254. Rotor 250 may be located within housing 210. Gas inlet 132 may be coupled through a valve 260, which functions as a flow restrictor, to a nozzle 262.

In operation, the backing pump connected to exhaust port 114 produces an air flow through gas inlet 132, valve 260, nozzle 262 and the interior of housing 210. The air flow is directed by nozzle 262 against blades 254 causing rotation of rotor 250. Because rotor 250 is connected to drive shaft 234, rotors 224 of turbomolecular compressor 220 and rotor disks 230 of molecular drag compressor 222 rotate. The rotation of the rotating elements of turbomolecular compressor 220 and molecular drag compressor 222 causes gas to be pumped by the vacuum pumping stages from inlet port 112 to exhaust port 114. Therefore, vacuum pump 110 is driven by gas turbine 130, and an electric motor is not required.

Gas turbine 130 is preferably located within housing 210 adjacent to a last vacuum pumping stage before exhaust port 114 and is preferably located near exhaust port 114. Gas turbine 130 may be located within the interior chamber 212 of housing 210 with the vacuum pumping stages or may be located in a separate compartment, depending on design considerations. However, in each case the vacuum pump and the gas turbine have a common connection to backing pump 120.

As described above, the gas outlet of gas turbine 130 is coupled to exhaust port 114. The last stage of vacuum pump 110, the gas outlet of gas turbine 130 and the inlet to backing pump 120 are connected together and must have compatible operating pressure levels. The pressure level at exhaust port 114 is preferably in a range of about 10 torr to 100 torr. Gas turbine 130 rotates the rotating elements of vacuum pump 110 at the speed required for operation of the vacuum pump, typically in a range of about 20,000 to 100,000 RPM.

Gas turbine 130 may have a variety of different configurations within the scope of the present invention. Different configurations of rotor 250 are known to those skilled in the art The gas turbine may include one or more nozzles for directing air at the rotor 250, or no nozzle. Valve 260 is optional and may have a permanent setting or may be manually adjustable or electrically programmable in accordance with operational conditions. Thus, inlet 132 of gas turbine 130 is at atmospheric pressure, and, depending on the setting of valve 260, the inlet to nozzle 262 is at or below atmospheric pressure.

By way of example, assume that the backing pump has a pumping speed of 5 liters per second (approximately 11 cubic feet per minute) and operates at a pressure of 50 torr. The air flow into the backing pump will be 50 torr×5 liters per second=250 torr liters per second. This air flow can be directly converted to units of power, giving 33 watts. Assuming 60% efficiency, 20 watts are available for driving the vacuum pump.

The vacuum pump 110 shown in FIG. 2 and described above is a hybrid pump which includes both axial turbomolecular stages and molecular drag stages. The present invention, wherein the vacuum pumping stages are driven by a gas turbine rather than an electric motor, may be applied to any vacuum pump which has one or more rotating members.

In a first example, the vacuum pumping stages are axial turbomolecular stages. Each axial turbomolecular stage includes a rotating member and a stationary member. Each rotating member and each stationary member has inclined blades, with the blades of the rotating and stationary members being inclined in opposite directions. The blades of the rotating members are rotated at high speed to pump gas. The construction of axial turbomolecular stages is well known to those skilled in the vacuum pump art.

Figure 2A:
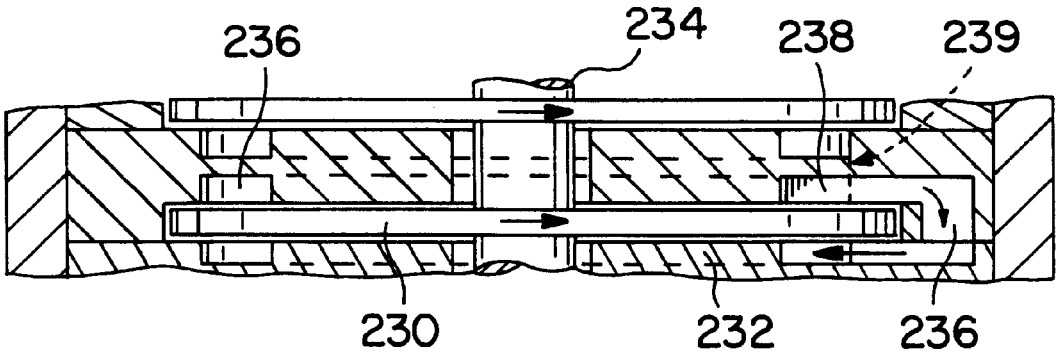
FIG. 2A is a cross-sectional elevation view of a molecular drag vacuum pumping stage.

In a second example, each of the vacuum pumping stages may comprise a molecular drag stage, which includes a rotating disk and a stationary member. The stationary member is provided with one or more tangential flow channels. Each tangential flow channel has an inlet and an outlet separated by a stationary baffle. Referring to FIG. 2A, at least one molecular drag stage of the molecular drag compressor 222 may include the stator 232 that is provided with a tangential flow channel. A stationary baffle 238 blocks tangential flow channel 236 at one circumferential location. The tangential flow channel 236 receives gas from a previous stage through an inlet 239 on one side of the stationary baffle 238. When the rotor disk 230 is rotated at high speed, gas is pumped through the tangential flow channel 236 by molecular drag produced by the rotating rotor disk 230 and pumped gas is discharged to the next pumping stage on the other side of the stationary baffle 238.

In a third example, the vacuum pump includes a molecular drag compressor wherein the rotating member comprises a cylindrical drum and the stationary member has a cylindrical interior wall in closely spaced relationship to the cylindrical drum. The rotating member may be provided with a helical groove on its outer surface. As the drum is rotated, gas is pumped through the groove by molecular drag.

Figure 2B:
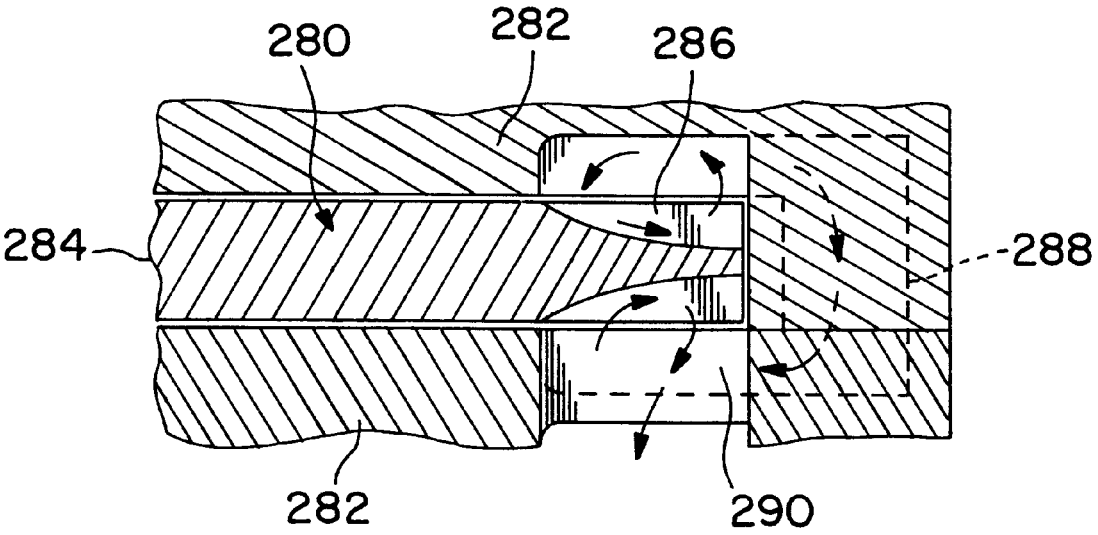
FIG. 2B is a partial cross-sectional view of a regenerative vacuum pumping stage.

In a fourth example, one or more of the vacuum pumping stages may comprise a regenerative vacuum pumping stage, which includes a regenerative impeller and a stationary member. The regenerative impeller is configured as a disk having spaced-apart radial ribs at or near its outer periphery. The stationary member is provided with a tangential flow channel which has an inlet and an outlet separated by a stationary baffle. Referring to FIG. 2B, the regenerative vacuum pumping stage includes a regenerative impeller 280 which operates with a stator 282. The impeller 280 comprises a disk 284 with spaced-apart radial ribs 286. Two portions of the stator 282 define a conduit 288 adjacent to the blockage 290. In operation, the disk 284 is rotated at high speed about the shaft (not shown). The rotation of the disk 284 and the ribs 286 causes the gas to be pumped as shown by arrows in FIG. 2B. When the regenerative impeller is rotated at high speed, gas is pumped through the tangential flow channel by the rotation of the disk and the radial ribs. Additional details regarding axial turbomolecular stages and regenerative stages are disclosed in U.S. Pat. No. 5,358,373 issued Oct. 25, 1994 to Hablanian, which is hereby incorporated by reference.

In a fifth example, the vacuum pump includes a combination of two or more types of vacuum pumping stages. For example, the vacuum pump may include axial turbomolecular stages and molecular drag stages as shown in FIG. 2 and described above. In each case, the rotating member of each vacuum pumping stage is attached through drive shaft 234 to gas turbine 130.

An advantage of the vacuum pumping system shown in FIGS. 1–3 and described above is that the vacuum pump is very compact. The pump length may be limited to the length required for the vacuum pumping stages and any length required for gas turbine 130 and bearing housing 240. In addition, the cost of the vacuum pump is reduced in comparison with prior art vacuum pumps by elimination of the electric motor. The invention is particularly advantageous in small and miniature vacuum pumps where size and weight are significant factors and where the cost of the electric motor may be a significant fraction of the total cost of the vacuum pump.

According to a further feature of the invention, the air flow for driving the gas turbine 130 may be channeled through the space where the pump bearings are located and/or through the stationary members of the vacuum pump for cooling before it is directed to the gas turbine.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A vacuum pump comprising:

a housing having an inlet port and an exhaust port for coupling to a backing pump;

one or more vacuum pumping stages disposed in said housing, each of said vacuum pumping stages comprising a stationary member and a rotating member; and a gas turbine comprising a gas inlet, a gas outlet coupled to said exhaust port, and a rotor coupled to the rotating members of said vacuum pumping stages, wherein a gas flow, produced by the backing pump, through said gas turbine causes said rotor and the rotating members of said vacuum pumping stages to rotate, wherein gas is pumped by said vacuum pumping stages from said inlet port to said exhaust port.

2. The vacuum pump as defined in claim 1 wherein at least one of said vacuum pumping stages comprises an axial turbomolecular stage, wherein said rotating member and said stationary member have inclined blades.

3. The vacuum pump as defined in claim 1 wherein at least one of said vacuum pumping stages comprises a molecular drag stage having a stationary member that is provided with a tangential flow channel having an inlet and an outlet separated by a stationary baffle, and a rotating member comprising a disk.

4. The vacuum pump as defined in claim 1 wherein said vacuum pumping stages comprise one or more axial turbomolecular stages and one or more molecular drag stages.

5. The vacuum pump as defined in claim 1 wherein at least one of said vacuum pumping stages comprises a regenerative stage.

6. The vacuum pump as defined in claim 1 wherein said exhaust port is adapted for coupling to a remotely-located backing pump.

7. The vacuum pump as defined in claim 1 wherein said gas turbine comprises a valve for controlling the gas flow through said gas turbine.

8. The vacuum pump as defined in claim 7 wherein said valve is manually adjustable.

9. The vacuum pump as defined in claim 7 wherein said valve is electrically programmable.

10. The vacuum pump as defined in claim 1 wherein said gas turbine comprises a nozzle for directing the gas flow from said an exit of said nozzle to the rotor of said gas turbine.

11. The vacuum pump as defined in claim 10 wherein the inlet of said gas turbine operates at atmospheric pressure.

12. The vacuum pump as defined in claim 1 wherein said exhaust port operates at a pressure in a range of about 10 torr or 100 torr.

13. The vacuum pump as defined in claim 1 wherein said gas turbine is positioned adjacent to a last stage of said one or more vacuum pumping stages.

14. The vacuum pump as defined in claim 1 wherein the rotor of said gas turbine and the rotating members of said vacuum pumping stages are coupled to a common shaft.

15. The vacuum pump as defined in claim 1 wherein the rotor of said gas turbine is located within said housing.

16. The vacuum pump as defined in claim 1 wherein said gas flow driving said gas turbine is channeled for cooling of the vacuum pump.

17. A vacuum pumping system comprising:

a vacuum pump comprising a housing having an inlet port and an exhaust port, one or more vacuum pumping stages disposed in said housing, each of said vacuum pumping stages having a stationary member and a rotating member, and a gas turbine comprising a gas inlet, a gas outlet coupled to said exhaust port, and a rotor coupled to the rotating members of said vacuum pumping stages; and a backing pump coupled to said exhaust port, wherein a gas flow, produced by said backing pump, through said gas turbine causes said rotor and the rotating members of said vacuum pumping stages to rotate, wherein gas is pumped by said vacuum pumping stages from said inlet port to said exhaust port.

18. The vacuum pumping system as defined in claim 17 wherein said vacuum pumping stages comprise one or more axial turbomolecular stages and one or more molecular drag stages.

19. The vacuum pumping system as defined in claim 17 wherein at least one of said vacuum pumping stages comprises a regenerative stage.

20. The vacuum pumping system as defined in claim 17 wherein said gas turbine comprises a valve for controlling the gas flow through said gas turbine.

21. The vacuum pumping system as defined in claim 17 wherein said gas turbine comprises a nozzle for directing the gas flow driving said gas turbine from said inlet to the rotor of said gas turbine.

22. The vacuum pumping system as defined in claim 17 wherein the rotor of said gas turbine and the rotating members of said vacuum pumping stages are coupled to a common shaft.

23. The vacuum pumping system as defined in claim 17 wherein the rotor of said gas turbine is located within said housing.

24. The vacuum pumping system as defined in claim 17 wherein said gas flow driving said gas turbine is channeled for a cooling of the vacuum pump.

* * * * *